United States Patent [19]

Kitayama et al.

[11] 4,227,945

[45] Oct. 14, 1980

[54] METHOD FOR PREVENTING DECARBURIZATION OF STEEL MATERIALS

[75] Inventors: Minoru Kitayama; Hisao Odashima, both of Himeji, Japan

[73] Assignee: Nippon Steel Corporation, Tokyo, Japan

[21] Appl. No.: 9,966

[22] Filed: Feb. 6, 1979

[30] Foreign Application Priority Data

Feb. 10, 1978 [JP] Japan ..... 53-14648

[51] Int. Cl.[2] ..... C23D 1/00

[52] U.S. Cl. ..... 148/6; 148/14; 427/383.7

[58] Field of Search ..... 148/14, 6; 106/44; 427/383 C

[56] References Cited

U.S. PATENT DOCUMENTS

| | | | |
|---|---|---|---|
| 3,178,321 | 4/1965 | Satterfield | 148/14 |
| 3,301,702 | 1/1967 | Ames et al. | 148/14 |
| 3,421,950 | 1/1969 | Frehn | 148/14 |
| 3,440,112 | 4/1969 | Ravault | 106/44 |
| 3,969,157 | 7/1976 | Hutterer | 148/14 |

*Primary Examiner*—Ralph S. Kendall

*Attorney, Agent, or Firm*—Toren, McGeady and Stanger

[57] ABSTRACT

A method for preventing decarburization of a steel material comprising applying a mixture of SiC powder and metallic Al powder on the steel material, further applying an oxidation inhibitor thereon, and heating thus coated steel material, so as to give 30 to 500 g/m$^2$ SiC on the steel material. The present method is particularly useful for preventing the lowering in strength of steel materials due to the surfacial decarburization.

3 Claims, 3 Drawing Figures

METHOD FOR PREVENTING DECARBURIZATION OF STEEL MATERIALS

BACKGROUND OF THE INVENTION

1. Field of the Invention

The present invention relates to a method for preventing decarburization of steel materials during heating.

Steel articles are generally produced by a process comprising heating steel materials in such forms as slabs, beam blanks, blooms and billets in a heating furnace and rolling them. However, scales are formed on the steel materials during their heating, resulting in a lowered product yield, accompanied with various problems, such as lowering in the commercial value of the products due to surface imperfection and lowering in the strength of the steel products due to decarburization.

Particularly in the case of steel materials, such as billets for wire rods or rail rods, which contain about 0.5 to 1.2% carbon, the influence on the steel quality by the lowering in strength due to the surfacial decarburization is very significant.

2. Description of Prior Art

For preventing the decarburization of steel materials during their heating, it has been proposed to apply an oxidation inhibitor on the steel surface, or apply a coating containing carbonaceous material on the steel surface and to keep in a reducing atmosphere for a time long enough for making the coating satisfactorily dense, as disclosed in Japanese Patent Publication No. Sho 42-12335, or to apply a duplex layer coating composed of a first layer of a substance which generates CO or $C0_2$ and a second layer of an oxidation inhibitor, as disclosed in Japanese Laid-Open Patent Specification No. Sho 49-97736.

However, none of the prior art has been proved to be successful; some requiring a considerably long time for keeping the steel materials in the heating furnace, others failing to produce desired results when the heating temperature is high or when the steel materials which contain a high carbon content.

Thus, the glass-like coating used in the Japanese Patent Publication No. Sho 42-12335, has no ability to completely shield the exterior gas, and it is impossible to avoid the oxidation of carbon in the surfacial layer of the steel materials by oxygen which diffuses through the coating if the heating time is long or high, or if the steel materials are high-carbon materials.

Meanwhile, in the Japanese Laid-Open Patent Specification No. Sho 49-97736, some of the CO or $CO_2$ generating substances show an exessively rapid decomposition rate, thus losing its decarburization preventing ability at a premature stage, while others are too stable to be decomposed at a desired stage, thus failing to produce a desired decarburization preventing ability. This prior art does not teach a substance having a decomposition rate optimum for the decarburization prevention. Moreover, the method disclosed by this prior publication is completely unable to prevent the decarburization of high-carbon steel materials such as a 1% carbon steel.

SUMMARY OF THE INVENTION

Therefore, one of the objects of the present invention is to overcome the above disadvantages of the prior art and to provide a very effective and consistent method for preventing the decarburization of steel materials.

The present invention has been completed after various experiments and studies made by the present inventors for achieving the above object, and is characterized in that the steel materials are heated with a very small amount of a mixture of specific substances, namely SiC and Al, both in the powder form, present between the steel surface and the oxidation inhibitor.

For coating the steel surface with the mixture of SiC-Al powders, inorganic binding agents, such as poly-phosphoric acid, aluminum diphosphate, water glass may be used, and various water-soluble resins may also be used, sometimes in the form of a mixture with water.

Regarding the oxidation inhibitors used in the present invention, any known oxidation inhibitor which is stable at high temperatures may be used. However, it is preferable to use an oxidation inhibitor composed of $Cr_2O_3$, reducing agent, refractory (or clay), $SiO_2$ and water glass as disclosed in Japanese Laid-Open Patent Specification No. Sho 49-30237, an oxidation inhibitor composed of refractory, $SiO_2$, ceramics, colloidal silica and water soluble resin as disclosed in Japanese Laid-Open Patent Specification No. Sho 52-57007, and an oxidation inhibitor composed of refractory (or clay or mica), $SiO_2$, metal powder, colloidal silica (or aluminal sol), and synthetic silica compound and soluble resin as disclosed in Japanese Patent Application No. Sho 51-108591 (U.S. patent application Ser. No. 808,668).

DETAILED DESCRIPTION OF THE INVENTION

The present invention will be described in more details referring to the attached drawings.

Figure 1:
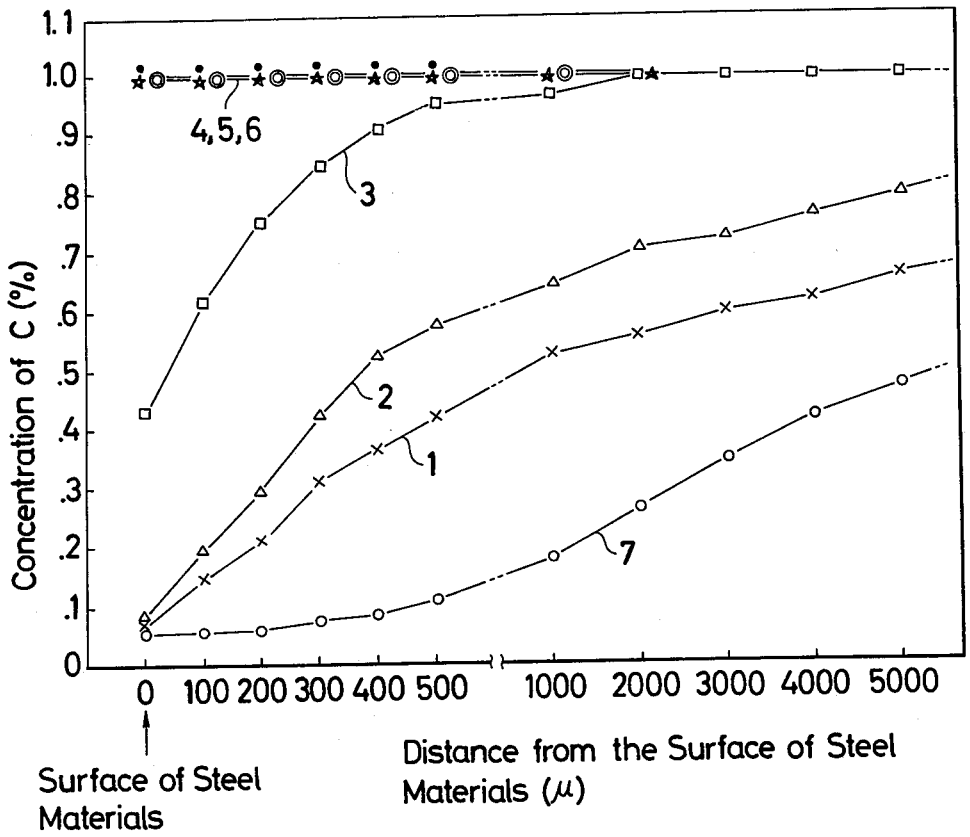
FIG. 1 is a graph showing the surfacial decarburization of steel materials observed when Al-SiC coatings with different proportions of Al to SiC are used.

The surfacial decarburization of the steel material varies depending on the proportion of Al to SiC contained in the mixture to be coated on the surface of the steel material as shown in FIG. 1.

In the experiments, the steel material was treated with the following conditions:

Steel material: 1.0% C steel

Lower coating composition (Al-SiC coating):

SiC(100 parts by weight)—Al(α)—polyacrylic acid (1% by weight)

Coated in such an amount as to assure 100 g/m$^2$ of SiC on the steel surface

Upper coating composition (oxidation inhibitor):

Chamotte—$SiO_2$—Al—colloidal silica—mica—water soluble resin

Coated in an amount of 0.5 kg/m$^2$

Heating: 1,150° C.×5 hrs

The proportion of Al to SiC (100 parts by weight) was changed as bellow:

(1) Al—0

(2) Al—20

(3) Al—30

(4) Al—50
(5) Al—100
(6) Al—1,000
(7) No lower coating was applied

From the above experiments, it has been found that the decarburization prevention can be markedly improved when Al is admixed in proportions not lower than 50 parts by weight to 100 parts by weight of SiC ((4)(5)(6)).

Figure 2:
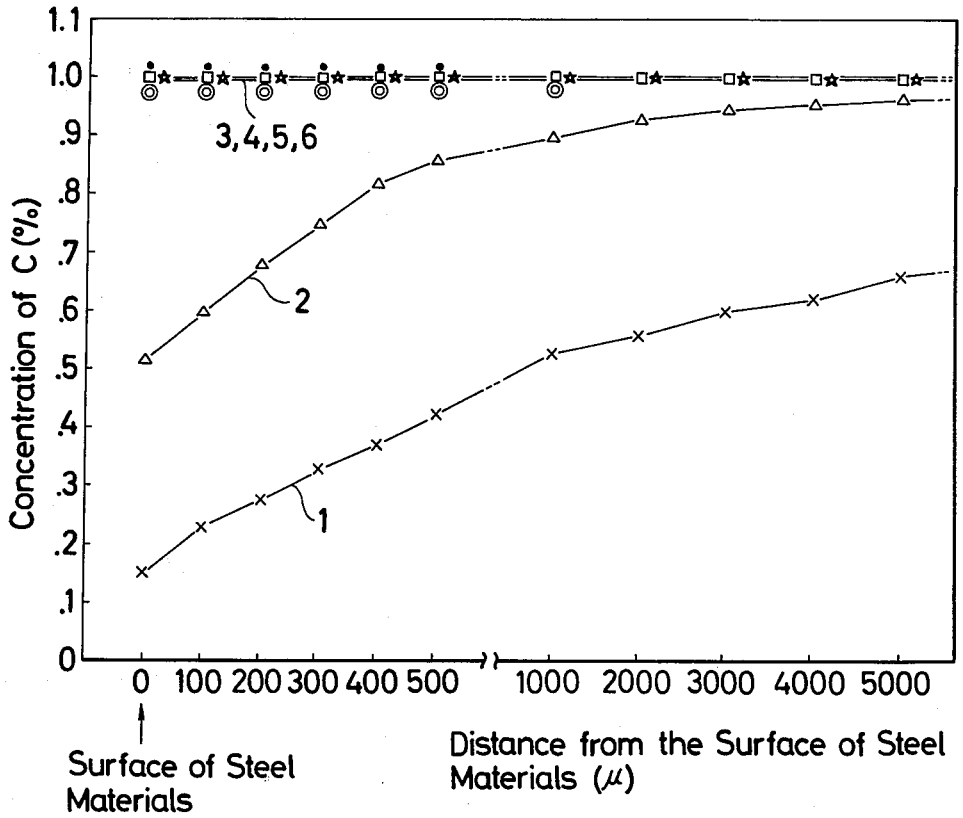
FIG. 2 is a graph showing the relation between the amounts of the Al-SiC coating and the surfacial decarburization of steel materials.

The surfacial decarburization of steel materials varies when the amount of the powder mixture of SiC (100)—Al (100) is changed as shown in FIG. 2.

In the experiments the steel material was treated with the following conditions.

Steel material: 1.0% C steel

Lower coating composition (Al-SiC coating): SiC (100 parts by weight)—Al (100 parts by weight)—polyacrylic acid (2% by weight)

Upper coating composition (Oxidation inhibitor): Same as in FIG. 1

Heating: Same as in FIG. 1

The lower coating composition was applied in the following amounts:

(1) an amount to give 10 g/m$^2$ of SiC
(2) an amount to give 20 g/m$^2$ of SiC
(3) an amount to give 30 g/m$^2$ of SiC
(4) an amount to give 50 g/m$^2$ of SiC
(5) an amount to give 100 g/m$^2$ of SiC
(6) an amount to give 1,000 g/m$^2$ of SiC It has been found that excellent decarburization prevention can be obtained when the mixture of SiC powder and Al powder is coated in amounts which give not less than 30 g/m$^2$ of SiC ((3)(4)(5)(6)).

Regarding the proportion of Al to SiC in the coating composition, and the amount of the coating composition to be coated on the surface of the steel material, there is no specific upper limit, but it is not economically advantageous to excessively increase the proportion of Al to SiC and to excessively increase the amount of the coating composition.

In general, when the proportion of Al is increased excessively, the general tendency is that the application of the coating becomes difficult.

For this reason, it is desirable in the present invention to admix 10 to 500, preferably 30 to 200 parts by weight of Al powder to 100 parts by weight of SiC powder and apply the mixture on the steel surface in such amounts as to give 10 g/m$^2$ to 1,000, preferably 30 to 500 g/m$^2$ of SiC.

The fact that very excellent decarburization preventing effect can be attained even in respect of high-carbon steel materials when the mixture of SiC powder and Al powder is coated on the surface of the steel materials and the oxidation inhibitor is applied thereon according to the present invention is attributed to the following mechanism.

Generally, SiC is stable at high temperatures, but the decomposition reaction, SiC→Si+C, takes place gradually and in a very small amount, and this decomposition product is present between the steel surface and the oxidation inhibitor. However, as the decomposition rate of SiC is so slow (that is, SiC is so stable), a part of the carbon resultant from the decomposition reaction unavoidably passes through the oxidation inhibitor and often escapes to the exterior so that an enough amount of carbon can not be held at the steel surface to satisfactorily prevent the decarburization. This is the problem confronted with by the prior art of Japanese Laid-Open Patent Specification No. Sho 49-97736 when SiC is selected. Whereas according to the present invention, when appropriate amounts of SiC and Al are mixed together and the mixture is applied on the steel surface, Al is gassified in a high temperature zone and this gassified Al has a strong reducing action, thus promoting the decomposition reaction SiC→Si+C.

The above decomposition reaction does not take place instantaneously, but it takes place gradually depending on the reaction temperature, and the time, so that the carbon fills the space between the steel surface and the oxidation inhibitor all the time. Therefore, even in the case of high-carbon steel materials, the decarburization can be almost completely prevented even when a high temperature and long time heating is applied. In this case, it is worthy to notice that if an aluminum compound is used in place of metallic aluminum, the reducing action of the compound is too weak to promote the decomposition reaction SiC→Si+C.

Also, it may be considered that carbides, such as CrC, TiC, $CaC_2$ and WC are used in place of SiC, but these carbides are very stable and even when they are mixed with Al powder, they hardly decompose even in a high temperature zone, so that no substantial decarburization preventing effect can be observed.

It is needless to say that when carbonaseous substances which produce CO and $CO_2$ by heating as disclosed in Japanese Patent Publication No. Sho 42-12335 are used, the decomposition reaction is promoted too rapidly and thus no technical significance is given by use of Al together with these carbonaceous substances.

As described above and understood from the above results, the decarburization can be almost completely prevented only when the mixture of SiC and Al as specifically defined in the present invention is used and in this point the economical advantage of the present invention is so great.

The present invention will be better understood from the following embodiments.

EXAMPLE 1

A steel billet (1.0% C) for wire rods was coated with a mixture of SiC powder (100 parts by weight), Al powder (150 parts by weight), and a small amount of polyacrylic ammon, in an amount to give 50 g/m$^2$ of SiC, and an oxidation inhibitor composed of chamotte, $SiO_2$, Al, mica, collioidal silica and water soluble resin was applied thereon in an amount of 0.7 kg/m$^2$. Then the steel billet thus coated was heated at 1130° C. for 5.0 hours.

Figure 3:
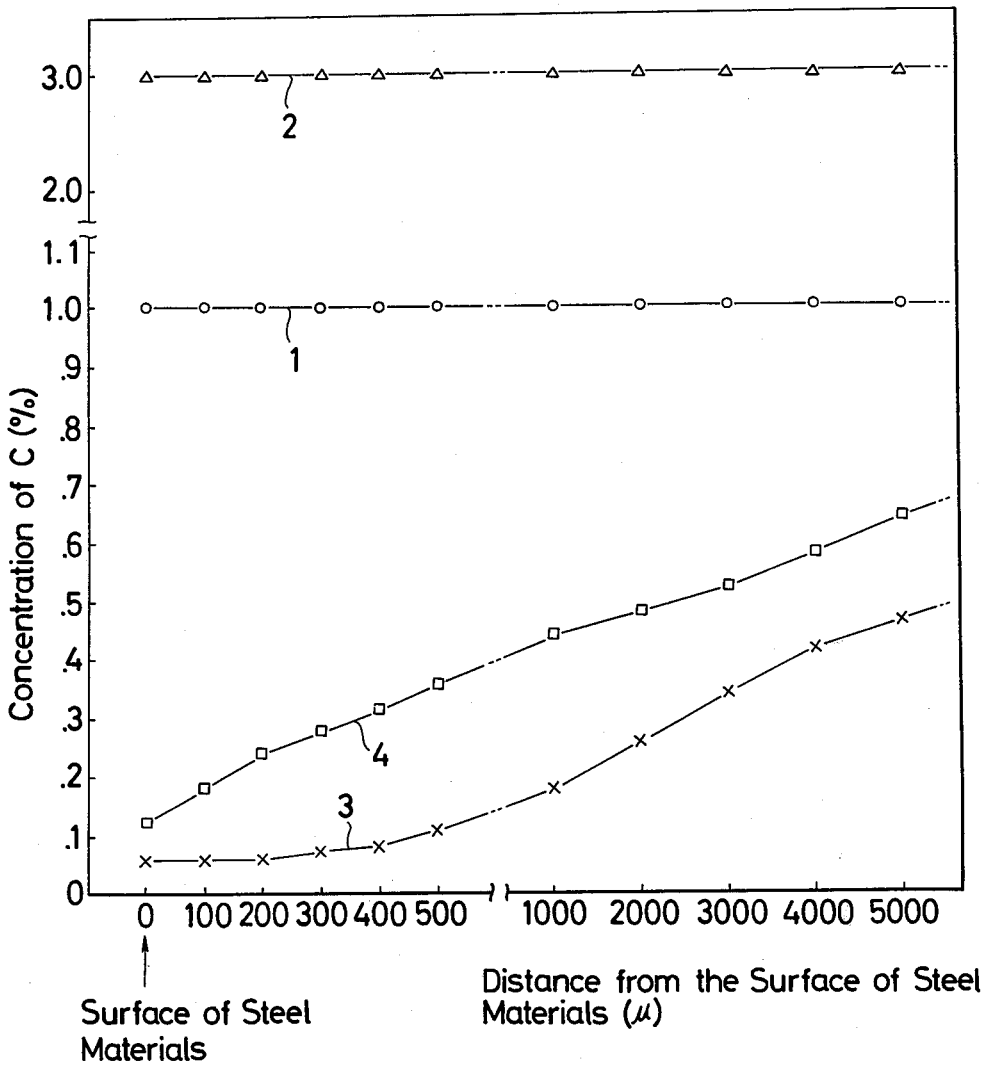
FIG. 3 is a graph comparing the surfacial decarburization in the examples of the present invention with that in comparative examples.

After the heating, the distribution of carbon across the cross section of the steel billet was analized by a X-ray microanalizer and the result is shown in FIG. 3, (1), from which it is clearly shown that almost no decarburization took place.

EXAMPLE 2

A cast steel (3.0% C) was coated with a mixture of SiC powder (100 parts by weight), Al powder (200 parts by weight), and a very small amount of acrylic amide water soluble resin, in an amount to give 100 g/m$^2$ of SiC, and an oxidation inhibitor composed of chamotte, $Si0_2$, Zn, mica, colloidal silica, and water soluble resin was coated thereon. Then the steel thus coated was heated at 1,100° C. for 7.0 hours.

After the heating, the destribution of carbon across the cross section of the steel was analized by a X-ray microanalizer and the result is shown in FIG. 3, (2), from which it is clearly shown that almost no decarburization took place.

Comparison

A steel billet (1.0% C) for wire rods was heated at 1,130° C. for 5.0 hours without a coating. Meanwhile, the same steel billet was coated with an oxidation inhibitor composed of chamotte, $SiO_2$, Al, mica, colloidal silica and water soluble resin, in an amount of 0.7 kg/m$^2$ and heated at 1,130° C. for 5 hours. Further the same steel billet was heated under the same condition except that a mixture of SiC powder and $Al_2(CO_3)_3$ powder was applied between the steel surface and the above oxidation inhibitor.

After the heating, the steel billets were analized by a X-ray microanalizer to observe the distribution of carbon across the cross sections of the billets. The results in the case of heating without a coating are shown in FIG. 3, (3), the results in the case of heating with only the oxidation inhibitor are shown in FIG. 3, (4), in which considerable decarburization was observed. Also the results in the case of heating with the mixture of SiC and $Al_2(CO_3)_3$ and the oxidation inhibitor were almost same as FIG. 3, (4).

What is claimed is:

1. A method for preventing decarburization of a steel material comprising applying a mixture consisting essentially of 10 to 500 parts by weight of metallic aluminum powder per 100 parts by weight of silicon carbide in an amount to give 10 to 1,000 g/m$^2$ silicon carbide on the steel material, further applying a solid coating type oxidation inhibitor thereon, and heating the thus coated steel material at a temperature range wherein carburization would normally occur.

2. A method according to claim 1, in which the mixture comprises 30 to 200 parts by weight metallic Al powder per 100 parts by weight of SiC powder.

3. A method according to claim 1, in which the mixture is applied on the steel material in an amount to give 30 to 500 g/m$^2$ SiC on the steel material.

* * * * *